US006527029B1

(12) United States Patent
Ryser

(10) Patent No.: US 6,527,029 B1
(45) Date of Patent: Mar. 4, 2003

(54) LABELLING STATION FOR ARTICLES, MORE PARTICULARLY BOTTLES, IN A LABELLING MACHINE WITH A QUIET, LOW-WEAR DRIVE

(75) Inventor: Urs Ryser, Muntelier (CH)

(73) Assignee: Fribosa AG Werkzeug-und Maschinenbau, Murten (CH)

( * ) Notice: Subject to any disclaimer, the term of this patent is extended or adjusted under 35 U.S.C. 154(b) by 0 days.

(21) Appl. No.: 09/485,396

(22) PCT Filed: Aug. 8, 1998

(86) PCT No.: PCT/EP98/05040

§ 371 (c)(1),
(2), (4) Date: Feb. 9, 2000

(87) PCT Pub. No.: WO99/08937

PCT Pub. Date: Feb. 25, 1999

(30) Foreign Application Priority Data

Aug. 13, 1997 (DE) ..... 197 35 086
Aug. 27, 1997 (DE) ..... 297 15 370 U
Sep. 10, 1997 (DE) ..... 297 16 294 U

(51) Int. Cl.[7] ..... B65C 9/06; B65C 9/12

(52) U.S. Cl. ..... 156/556; 156/566; 156/567; 156/569; 156/DIG. 25; 156/DIG. 30

(58) Field of Search ..... 156/566, 567, 156/568, 571, 578, DIG. 29, DIG. 30, DIG. 31, DIG. 32, 556, 569, DIG. 25

(56) References Cited

U.S. PATENT DOCUMENTS 3,928,120 A * 12/1975 Zodrow ..... 156/568
4,060,229 A * 11/1977 Carter ..... 271/33
4,298,422 A * 11/1981 Zodrow ..... 156/568
4,336,098 A * 6/1982 Zodrow ..... 156/568
5,004,518 A * 4/1991 Zodrow ..... 156/568
5,017,261 A * 5/1991 Zodrow et al. ..... 118/230

FOREIGN PATENT DOCUMENTS

DE 39 08 378 A1 9/1990

* cited by examiner

*Primary Examiner*—Richard Crispino
*Assistant Examiner*—Sue A. Purvis
(74) *Attorney, Agent, or Firm*—Proskauer Rose LLP

(57) ABSTRACT

The invention relates to a labelling station for articles, more particularly bottles, having removal elements (2) which are rotatably mounted on a rotating support (1) and are moved past fixed stations (15, 16, 19) disposed at the periphery of the support with each rotation thereof and which roll with their receiving surface (5) with synchronisation at the stations and are glued, a label being delivered to a label-transferring station. The drive used for the removal elements (2) is a cam drive with two sets of engagement members (24, 25; 29, 30) which engage with a double cam **(20*a*, 20*b*). The drive is so designed that, apart from short transitional zones, of the engagement members only two engagement members engage, one engagement member having a longer operative lever arm than all the remaining engagement members, and said engagement member 25 being also in torque-operative driving engagement with the double cam 20*a*, 20*b*** in the initial phase of the rolling movement of the receiving surface at the stations.

14 Claims, 7 Drawing Sheets

LABELLING STATION FOR ARTICLES, MORE PARTICULARLY BOTTLES, IN A LABELLING MACHINE WITH A QUIET, LOW-WEAR DRIVE

BACKGROUND OF THE INVENTION

The invention relates to a labelling station for articles, more particularly bottles, having a number of stations disposed one after the other along a path, namely a gluing roller, a label box, a label-transferring cylinder and at least one label-removing element which is rotatably mounted on a rotating support and is moved past the stations with each rotation of the support and which has an outwardly curved label-receiving surface rolling on the front label of the label box and on the other stations respectively, the drive provided for each label-removing element being a cam drive comprising a fixed double cam disc, common to all the removal elements, with single-side cams disposed spaced-out in two planes one above the other and two sets of engagement members which are mounted via a support element on a driving shaft of the removal element and with the rotation of the support ensure by positive connection with the two cams the constrained movement of each removal element over its full rotation, the driving shaft terminating in front of the plane in which the first cam closest to said shaft lies, while the engagement members associated with the second cam are mounted rotatably offset on a bridge member lying between the two cams and borne by the engagement members of the first cam.

Labelling stations of the kind specified are known and have proved their value in practice. They enable high throughputs to be achieved, since the removal elements perform exclusively rotary movements and no oscillating movements, so that the positive and negative accelerations which are required to roll the removal elements by their curved receiving surfaces at the different stations can be relatively small. In the prior art labelling stations the rotary movement of the removal elements is derived from outside curves with which engagement members engage and transmitted via transmission gearing to the removal elements. The engagement members can both be disposed symmetrically and have operative lever arms of the same length (DE 38 11 869 A1) or be disposed asymmetrically and have lever arms of different lengths (DE 39 08 378 A1). In the latter case the rotationally offset engagement members of different lengths allow improved constrained guiding at critical places. In any case, such drives, which require transmission gearing, are expensive and due to the large number of structural elements participating in the rotary movement they are imprecise and not exactly quiet and low-wear.

In another prior art labelling station (DE 29 01 853 C2) the cams of the double cam disc of the cam transmission of each removal element are internally toothed after the fashion of a lantern gear toothing. In this cam transmission associated with each cam disc are four engagement members disposed on a common support non-rotatably located on the removal element driving shaft, which extends as far as a bearing below the underside engagement members. The advantage of such a cam drive is that transmission gearing is no longer required. However, the number of engagement members is substantially higher than their number in the other prior art labelling station, since otherwise in view of the relatively low teeth secure engagement cannot be ensured over an angle of rotation of 360° of the removal element. For this reason, even with the two cams in each phase of the rotary movement at least three engagement members are engaged, namely two adjacent engagement members of one set and one engagement member of the other set, while in the phase of the transfer of the principal guide, even four engagement members are engaged, namely two members of the first set and two members of the other set.

SUMMARY OF THE INVENTION

It is an object of the invention to provide a labelling station of the kind specified wherein the drive of the removal element is as quiet and low-wear as possible with low construction expense.

This problem is solved according to the invention by the features that at least in the zone of the stations the double cam disc with its two cams is so constructed after the fashion of an internally toothed lantern gear that the rotary movement of the removal elements is derived directly (without transmission gearing) therefrom, while at the same time except for short transitional zones of the engagement members only one engagement member per set is in engagement with the double cam.

The labelling station according to the invention ensures a secure engagement over the full range of rotational angle of 360° of the removal elements using a minimum of engagement members, since due to the bridge member the teeth of the lantern gear toothing can extend into the zone of the imaginary elongation of the driving shaft. Except for short transitional zones, two active engagement members are enough for such a secure engagement of the engagement members and therefore also for the initiation of a torque. This applies even in the particularly critical zones in which the downward rolling movement requires a high torque, as in the starting phases of the rolling movement at the different stations. As a whole, therefore, minimum constructional expenditure is involved. Reduction of noise and wear are achieved by the elimination of the transmission gearing and the engagement of the engagement members, reduced to a minimum. To reduce the acceleration movements, the modulus can even be so designed that it produces a slight backward rotation at the end of the movement between the stations.

In critical zones, in which the rolling movement requires a high torque, in one embodiment of the invention this is provided for by the feature that of the engagement members only one engagement member has the longer operative lever arm than the other engagement members and in the initial phase of the rolling movement of the receiving surfaces on the stations said engagement member is additionally in torque-operative, driving engagement with the double cam.

In a possible feature of the invention, to further reduce noise while still providing secure guidance, at least in certain zones the lantern gear toothing is constructed with clearance at the bases of the teeth and/or in the zone of the stations the engagement of the engagement members is limited to the tooth flanks of the cam.

According to another feature of the invention the modulus of the double cam between the stations is so large that after leaving a station the removal element is rotated only as far as the required rotary position at the start of the rolling movement on the next station. Preferably the modulus between individual stations is adapted to rotary movement up to stoppage. This can be achieved if when a station is left behind the rotary movement is continued at only a slightly reduced rotationally angular speed up to an angle at which the rotary movement is resumed at the next station. In this way even stoppage may occur, in which the drive emits no further noise.

The modulus of the lantern gear toothing in the zones between the stations can be varied in value. On the one hand to enable articles to be conveyed along the label-transferring cylinder, but on the other hand to make the stations as accessible as possible, which must be kept free for the frequent intervention of the operating personnel, the value of the modulus between the label-transferring cylinder and the gluing roller can be as large as possible; in the extreme case, as described, it can even be to the stoppage of the rotary movements, while in the zone of the gluing roller and the label box it is very small, so that these two stations can be disposed at an angle of approximately 90°.

Advantageously, to allow an optimum design of the lantern gear toothing the mutual rotary angle offsetting of at least some of the engagement members is ≠90°. To reduce wear and noise, also advantageously the engagement members run gently on to and off the supporting tooth flanks by the drawing-back thereof.

To obtain an embodiment which is particularly effective in the reduction of noise and wear according to the invention in the direction of rotation of the support the internally toothed cams have in a portion both downstream of the label box and also downstream of the gripper cylinder a substantially larger modulus than in the zone between the gluing roller and the label box, and the engagement member with the longer operative lever arm is at the start of the cam portion with the larger modulus in torque-operative engagement with a flank of a tooth of the associated cam, which has in the zone of the tooth tip a maximum angle of 70° in relation to the radius of the support through the axis of rotation of the removal element. The angle of inclination should be 50° at most, the optimum value being approximately 60°, the result being particularly favourable conditions for the introduction of the engagement member with the larger lever arm.

The introduction conditions can be further improved by the feature that immediately after leaving the label box, the particular removal element is accelerated until the engagement member with the longer lever arm comes into engagement with the associated cam.

Lastly, advantageously for optimum conditions of engagement and introduction of the engagement members according to the invention at all stations the tooth tips of the double cam lie laterally of the radii of the support extending through the centre of the stations.

Advantageously the invention can be put into effect with a central lubricating system for the bearings of the driving shaft and the engagement members. In that case according to the invention the driving shaft of each removal element has a bearing which is disposed above the support element for the engagement members and above which a lubricant supply element is disposed fixed on the support. The bearing is lubricated when it passes the fixed lubricant supplying system. The lubricant drips by gravity from bearing on to the engagement members. Lubricant distribution is particularly effective if on its side adjacent the bearing, the support element takes the form of a distributing plate for the lubricant dripping from the bearing and to be delivered to the engagement members partially extending beyond the edge of the distributing plate.

BRIEF DESCRIPTION OF THE DRAWINGS

An embodiment of the invention will now be explained in greater detail with reference to drawings, which show.

DETAILED DESCRIPTION OF THE INVENTION

Figure 1:
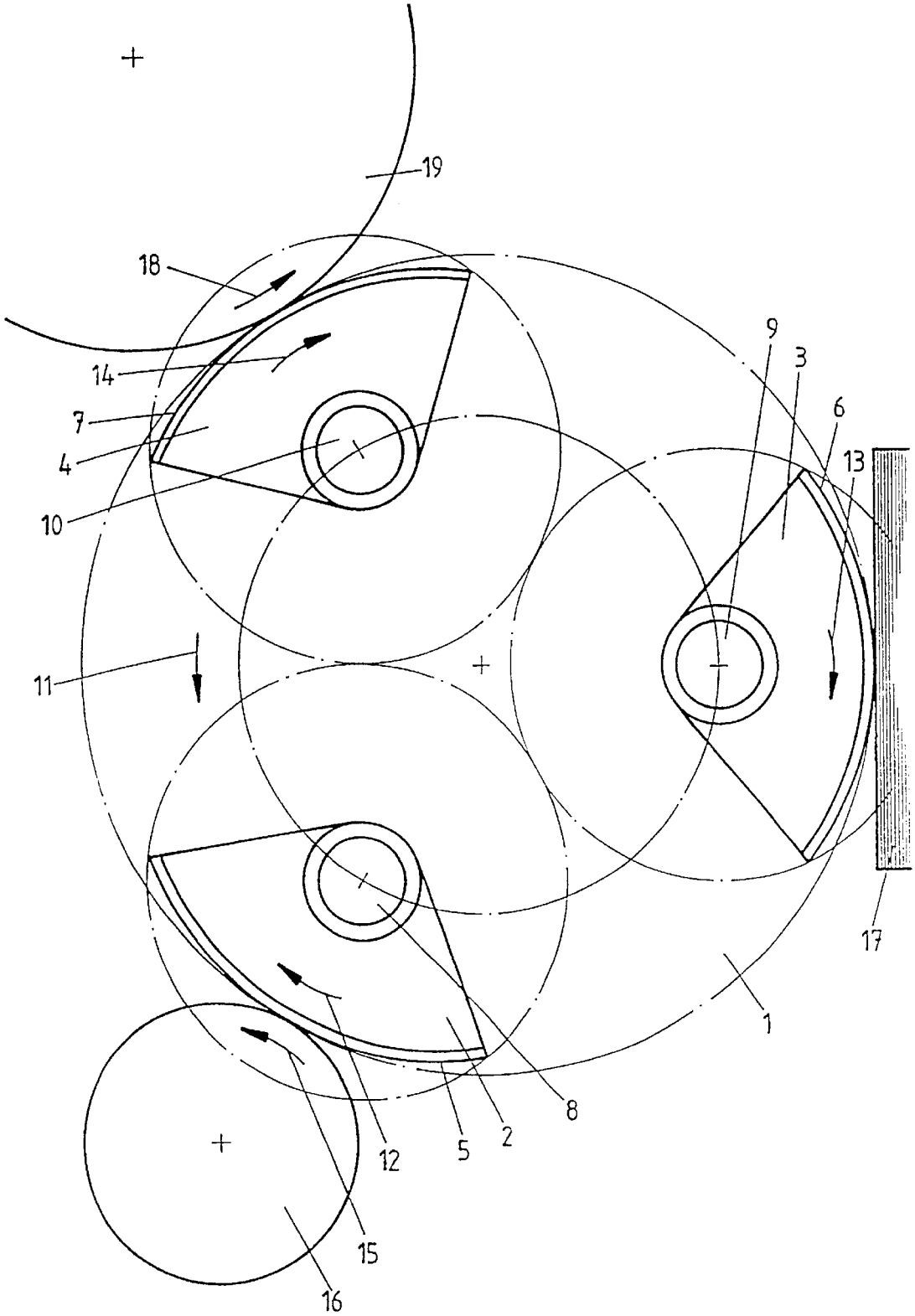
FIG. 1 a diagrammatic elevational view of a labelling station of a labelling machine for articles, more particularly bottles, FIG. 2 a diagram of the labelling station shown in FIG. 1, with a double cam disc and a removal element engaging with the double cam in the zone between the label-transferring cylinder and the gluing roller, FIG. 3 a diagram of the labelling station shown in FIGS. 1 and 2 with a removal element operative on a gluing roller, FIG. 4 a diagram and section through the labelling station shown in FIGS. 1 and 2, with the removal element operative on a label box, FIG. 5 an axial section through a driving shaft of a removal element of a labelling station as shown in FIGS. 1 and 2, with bearing and a bridge member with two sets of engagement members, FIG. 6 the bridge member shown in FIG. 5, sectioned along the line A—A in FIG. 4, FIG. 7 the bridge member shown in FIG. 5, sectioned along the line B—B in FIG. 4, FIG. 8 a diagram of a variant embodiment of FIG. 2, showing the labelling station in FIG. 1, with a double cam disc and a removal element engaging with the double cam at different places, and FIG. 9 a diagram of the labelling station shown in FIGS. 1 and 8.

Referring to the drawings, a labelling station comprises a support 1 on which three removal elements 2, 3, 4 are disposed at identical angles. Each removal element 2, 3, 4 has a cylindrically curved receiving surface 5, 6, 7 for a label. Each removal element 2, 3, 4 is mounted to be rotated by a driving shaft 8, 9, 10 in the support 1 between said curved receiving surface 5, 6, 7 and its centre of curvature. When the support 1 rotates as indicated by arrow 11, the removal elements 2, 3, 4 are constrainedly rotated by cam drives in the direction indicated by arrows 12, 13, 14—i.e., oppositely from the support 1.

When the support 1 rotates, the removal elements 2, 3, 4 are moved past different stations, mainly past a gluing roller 16 rotating in the direction of arrow 15, a fixed label box 17 containing a stack of labels and a label-transferring cylinder (gripper cylinder) 19 rotating in the direction of arrow 18, the receiving surfaces 5, 6, 7 performing a rolling movement at the individual-stations. First the receiving surface 5, 6, 7 of each removal element 2, 3, 4 is glued by the gluing roller 16. During the downward rolling movement on the front label of the stack in the label box 17, said front label is taken from the stack by the adhesive effect of the glue on the receiving surface 5, 6, 7 and, on further rotation of the support 1 is supplied to the label-transferring cylinder, which removes it from the receiving surface 5, 6, 7.

Figure 2:
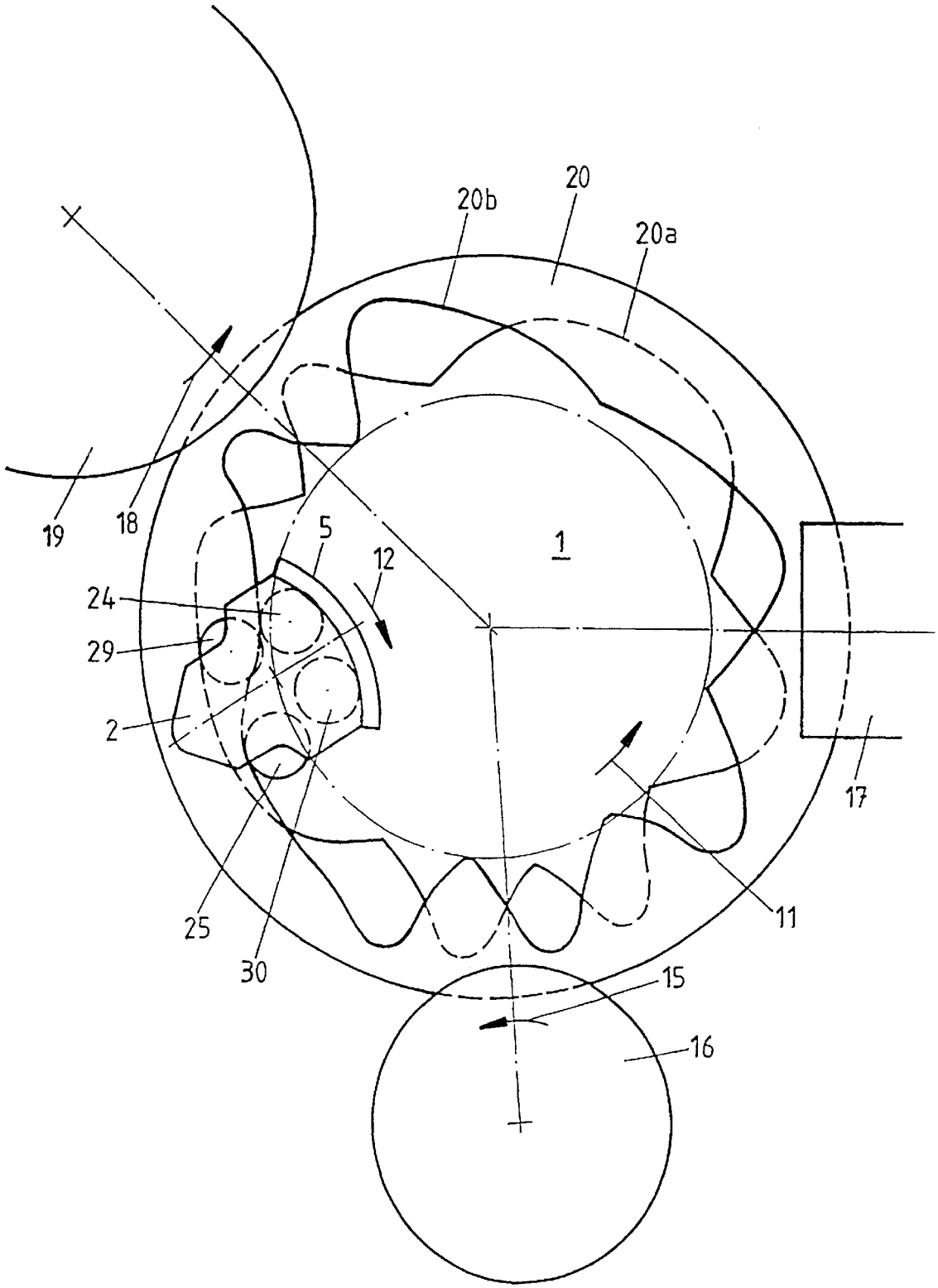
Figure 3:
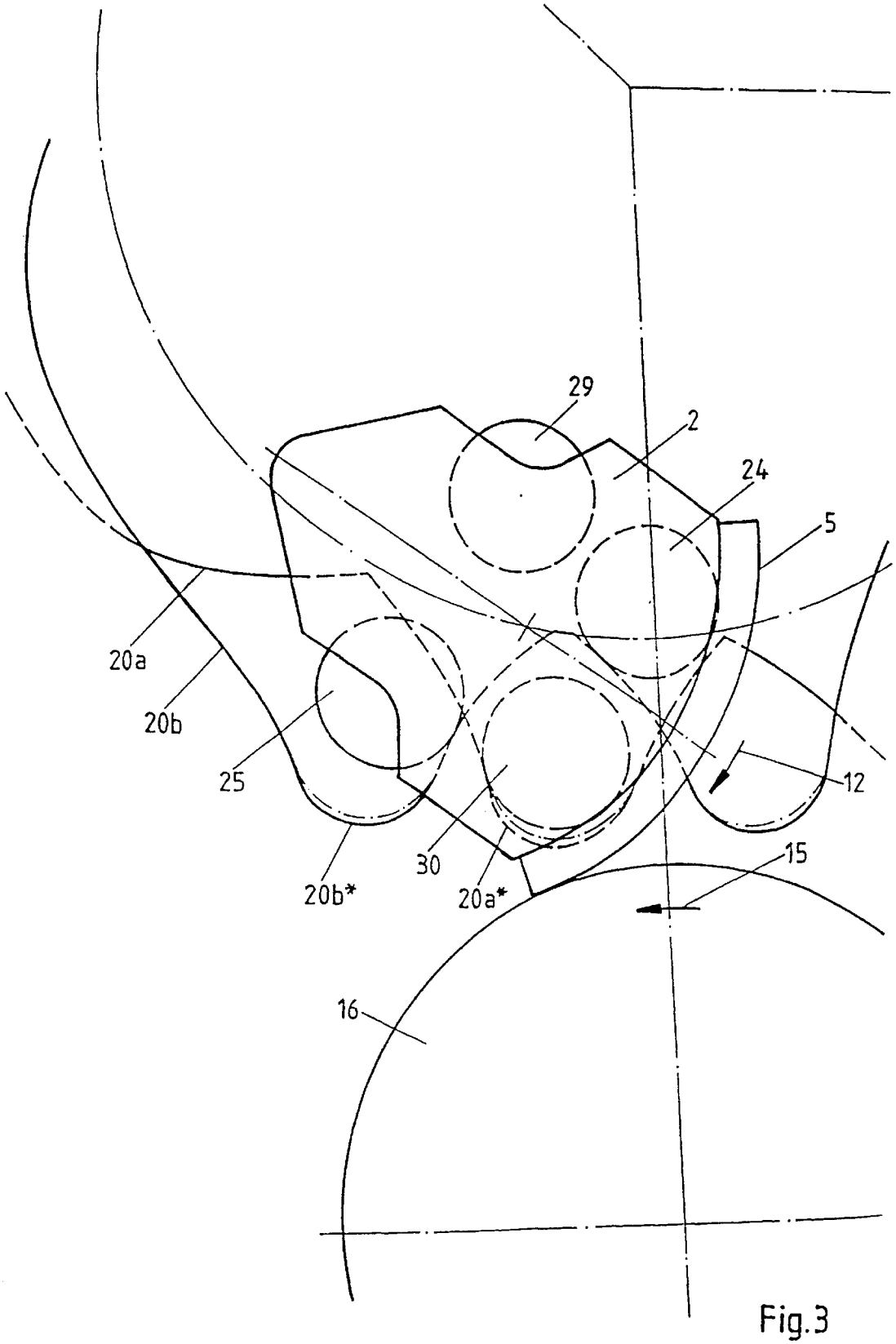
Figure 4:
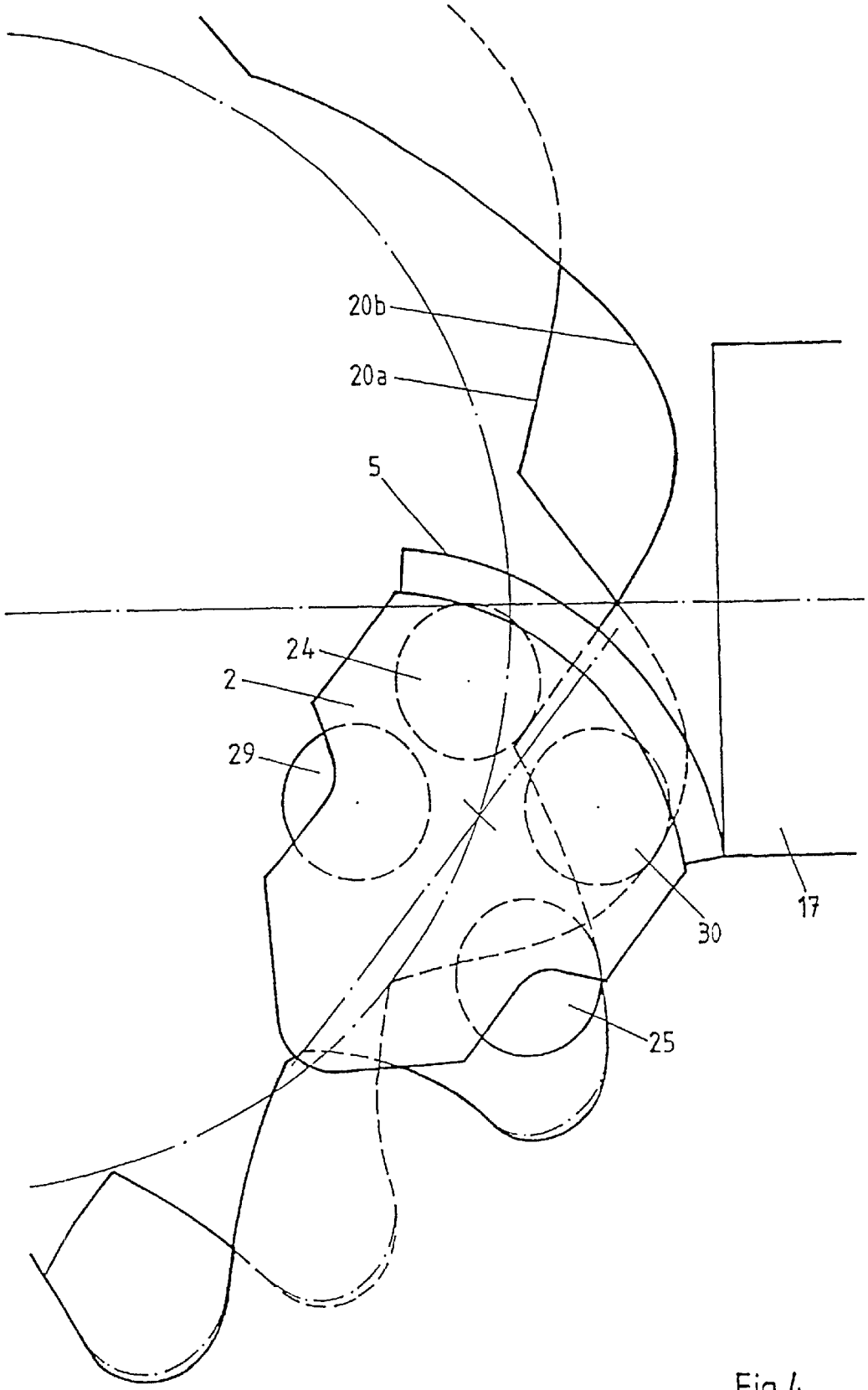
Figure 5:
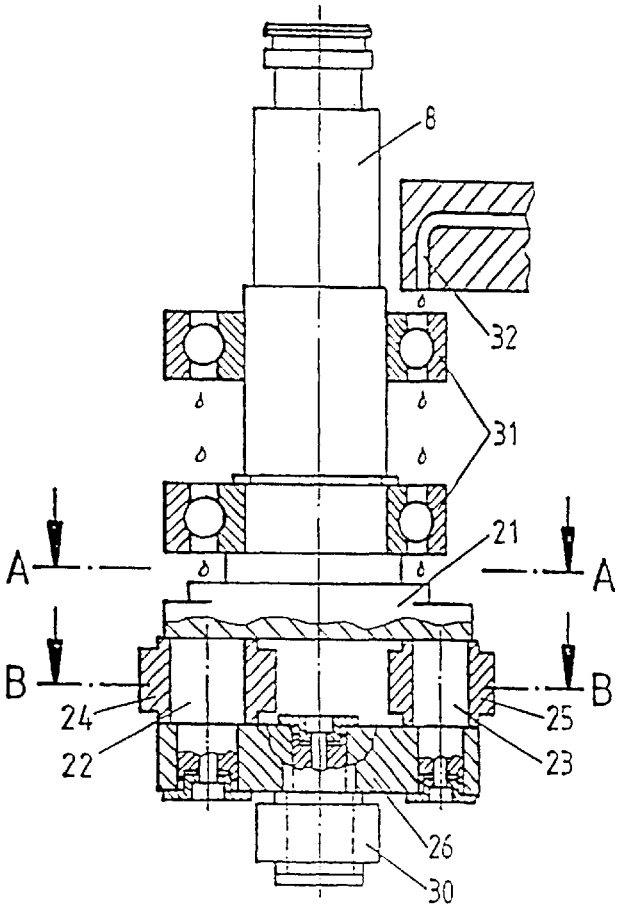
Figure 6:
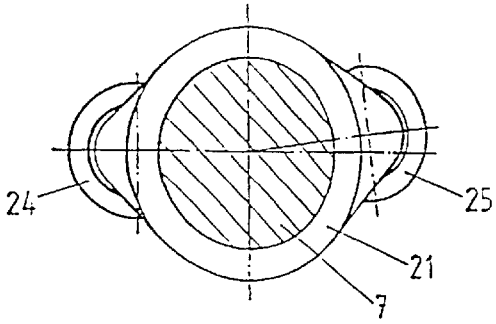
Figure 7:
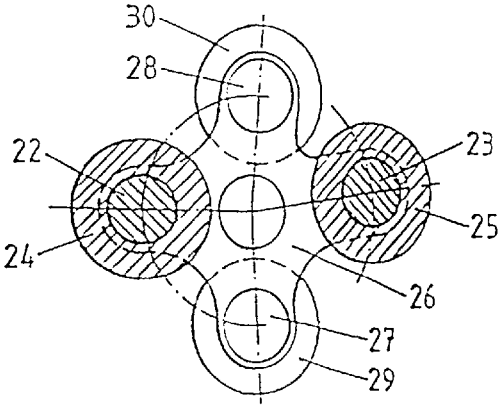

To enable the receiving surfaces 5, 6, 7 to roll at the differently designed stations 16, 17, 19, the rotary movement of each removal element 2, 3, 4 in the direction indicated by arrows 12, 13, 14 must be accelerated and decelerated. To this end the aforementioned cam drives are provided, which consist of: a fixed common double cam disc 20 with one-sided cams 20*a*, 20*b* disposed spaced-out in two planes one above the other after the fashion of a lantern gear toothing whose modulus is not constant; and sets of two engagement members each which are associated with the individual removal element 2, 3, 4 and which engage with the cams 20*a*, 20*b*, as shown by FIGS. 2, 3, 4. For this purpose, attached to the lower end of the driving shaft 6, 7, 8 of each removal element 2, 3, 4 is a support element 21, more particularly constructed unitary with the shaft, which bears on its underside two moulded-on pins 22, 23 with a set of rollers 24, 25 disposed thereon as engagement members. Attached to the pins 22, 23 is a bridge member 26 which bears, offset by an angle of approximately 90° to the pins 22, 23, pins 27, 28 for a further set of rollers 29, 30 as engagement members. As shown in FIG. 4, the support element 21 takes the form of a distributing plate. The rollers 24, 25; 29, 30 extend beyond its periphery. Above the support element 21 the driving shaft 7 is disposed in a double bearing system 31, a fixed bearing supply system being provided disposed in the machine frame. The bearing 31 and the rollers 24, 25; 29, 30 passing the lubricant supply system at each rotation of the removal elements receive lubricant from said lubricant supply system 32 which is distributed over the two bearings of the bearing system 31, then to the distributing plate 21, thence passing to the rollers 24, 25; 29, 30 and therefore also to the cams 20*a*, 20*b*. The special construction of the support element 21 constructed unitary with the shaft and having the moulded-on pins 22, 23 but also the special lubricant supply system also have independent inventiveness.

As shown by FIGS. 2 to 4 and also 6 and 7, not all the engagement members 24, 25; 29, 30 are disposed with an angular offsetting of 90°, but some of them have more and some less. Moreover, the operative lever arm of the engagement member 25 is larger than the operative lever arm of the other engagement members 24, 29, 30.

As can be gathered from FIGS. 3 and 4, the cams 20*a*, 20*b* taking the form of a mangle gear toothing are constructed with clearance at the tooth bases, as indicated at two places 20*a, 20*b in FIG. 2. This construction helps to further reduce noise and wear, since it prevents the third engagement member from remaining engaged at the bases of the teeth and causing an overdefinition. The zones with clearance at the bases of the teeth are more particularly provided where the modulus of the toothing is small. This depends on the radius of curvature of the station—i.e., it is smaller at the gluing roller 16 than at the flat front side of the label box 17. The modulus can be particularly large in the zones between the stations, where stoppage can actually take place, as provided for the zone shown at the bottom left of FIG. 3. It is even conceivable for a slight backward rotation to take place in this zone, if the result is that better results can be achieved in the deceleration and acceleration of the removal elements and therefore in the loading of the elements participating in the movement and a reduction in noise. In any case, the geometry of the cam drive is so devised that, except for a few short transitional zones, only one engagement member of each of the two sets is ever in engagement with the cams 20*a*, 20*b*. By the drawing-back of material the two flanks are so shaped that each engagement member can gently enter and leave each flank. Lastly and more particularly, however, only the engagement member 23 with the longest lever arm is driving and torque-operative at the start of the downward rolling movement of a removal element at a station, as shown in FIG. 2.

Figure 8:
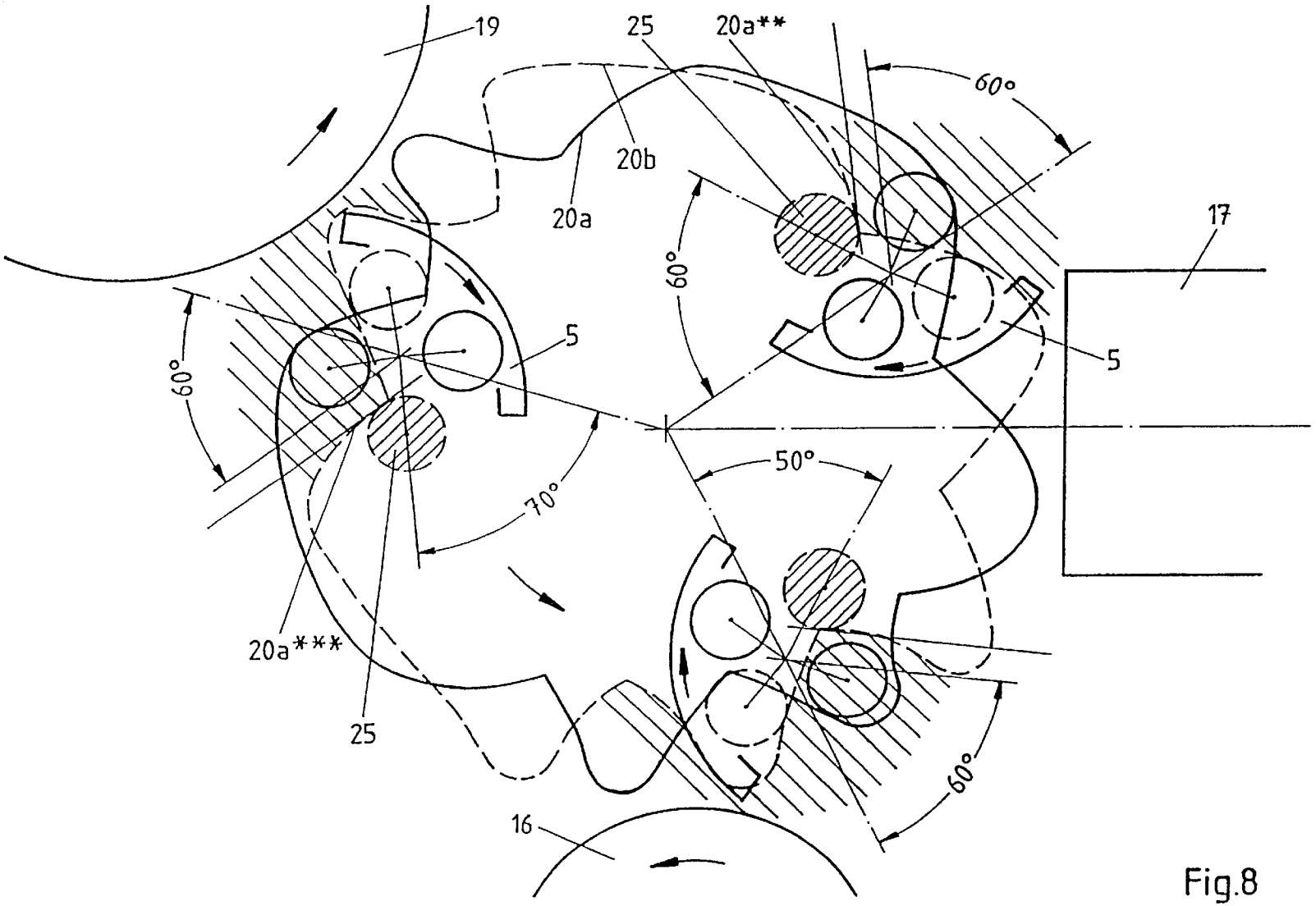
Figure 9:
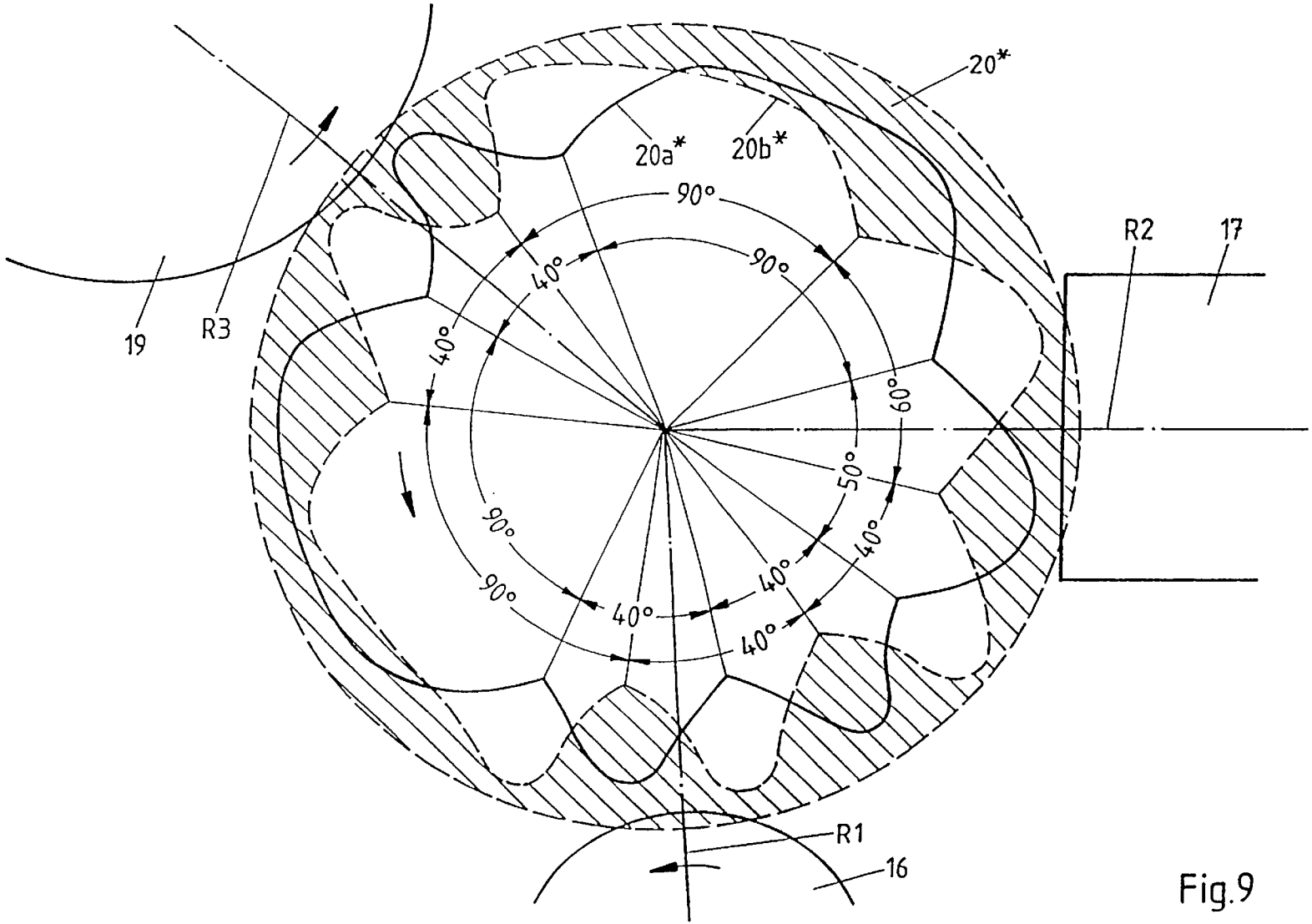

The embodiment shown in FIGS. 8 and 9 differs from that illustrated in FIG. 2, since the cams 20*a*, 20*b* follow a somewhat different course. However, in agreement with the cam shown in FIG. 2, the tooth tips of the two cams 20*a*, 20*b* lie laterally alongside the radii R1, R2, R3 which extend through the centres of the individual stations 16, 17, 18. Another similarity is that the modulus of the cams 20*a*, 20*b* in the direction of rotation of the support 20 is substantially larger in the first portion downstream of the label box 17 and in the first portion downstream of the gripper cylinder 19 and in the zone between the gluing roller 16 and the label box 17.

One important difference in the course of the cams in this embodiment is that at the start of the portion with the large modulus the engagement member 25 having the longer lever arm impinges on the flank of a tooth 20*a*, 20*a with a relatively small modulus when the removal element 5 is just leaving the label box 17 and the gripper cylinder respectively. The angle of inclination of the flank of the tooth 20*a*, 20*a** to the radius of the support through the axis of rotation of the removal element 5 is approximately 60°. The engagement member 25 runs up on the flanks of the teeth 20*a*, 20*a**** at acute angles between 50° and 70° to the radius of the support through the axis of rotation of the particularly removal element.

Another special feature is that after leaving the label box 17 the removal element 5 is accelerated as against the movement at the label box 17, to make it easier for the engagement member 25 to impinge gently on the tooth flank.

The result of all these steps is that with minimum constructional expenditure the cam drive is extremely quiet and low-wear.

What is claimed is:

1. A labelling station for articles comprising:

a number of stations disposed sequentially along a path, said stations including:

a gluing roller;

a label box with a front label;

a label-transferring cylinder; and at least one label-removing element, which is rotatably mounted on a rotating support and is moved past the stations with each rotation of the support, and which has an outwardly curved label-receiving surface rolling on the front label of the label box and on one of the stations respectively, wherein each label-removing element includes a cam drive comprising:

a fixed double cam disc, wherein said double cam disk comprises tooth tips, tooth flanks and tooth bases, common to each label-removing element, with single-sided cams disposed spaced-out in two planes, wherein a first cam is disposed on a first plane and a second cam is disposed on a second plane and the planes are one above another, and two sets of engagement members which are mounted via a support element on a driving shaft of each label-removing element, and a rotation of the support ensuring a constrained movement of each label-removing element over its full rotation by positive connection with the first and second cams, wherein the driving shaft terminates in front of the first plane in which the first cam closest to the shaft lies, while the engagement members associated with the second cam are mounted rotatably offset on a bridge member lying between the two cams and borne by the engagement members of the first cam, wherein at least in proximity of the stations, the double cam disc with its two cams is so constructed as an internally toothed lantern gear so that the rotary movement of each label-removing element is derived directly therefrom, while in definite zones of engagement at the stations, only one engagement member per set of engagement member is in engagement with the double cam, and in other definite zones of engagement at the stations at maximum an additional engagement member is in engagement with the double cam, wherein the tooth-tips of the double cam extend into that region of the bridge member which is vacant of the driving shaft.

2. A labelling station according to claim 1, wherein only one of the engagement members has an operative lever arm longer than the other engagement members and wherein said engagement member is additionally in torque-operative driving engagement with the double cam while in an initial phase of a rolling movement of the receiving surfaces on the stations.

3. A labelling station according to claim 2 wherein, in the direction of the rotation, the internally toothed cams have in a portion both downstream of the label box and also downstream of the label-transferring cylinder a substantially larger modulus than between the gluing roller and the label box, and the engagement member with the longer operative lever arm is at a start of the cam portion with the larger module in torque-operative engagement with a flank of the tooth of the associated cam which has in proximity of the tooth tip a maximum angle of 70° in relation to a radius of support through an axis of rotation of the removing element.

4. A labelling station according to claim 1, wherein the engagement of the engagement members in the zone of the engagement at the stations is limited to the tooth flanks of the cams.

5. A labelling station according to claim 1, wherein the lantern gear toothing is constructed with clearance at the tooth bases at least in certain zones.

6. A labelling station according to claim 1, wherein a modulus of the double cam between the stations is so large that after leaving a station, the label-removing element is rotated only as far as required by a rotary position at the initial phase of the rolling movement at a next station.

7. A labelling station according to claim 6 wherein the modulus between individual stations is adapted for rotary movement up to stop.

8. A labelling station according to claim 1 wherein the tooth tips of the double cam lie laterally of a radius of the support extending through a center of the stations at each station.

9. A labelling station according to claim 8 wherein the support element on its side adjacent the bearing comprises a distributing plate for a lubricant dripping from the bearing and to be delivered to the engagement members partially extending beyond an edge of the distributing plate.

10. A labelling station according to claim 8 wherein the engagement members are formed on an underside of the support element.

11. A labelling station according to claim 1 wherein the driving shaft of each removing element has a bearing which is disposed above the support element for the engagement members and above which a lubricant supply element is disposed fixed on the support.

12. A labelling station according to claim 1, wherein a mutual rotary angle offsetting of at least some of the engagement members differs from 90°.

13. A labelling station according to claim 12 wherein an angle of inclination is at least 50°.

14. A labelling station according to claim 12 wherein immediately after leaving the label box, the label-removing element is accelerated until the engagement member with the longer lever arm comes into engagement with an associated cam.

* * * * *